US009451856B2

(12) United States Patent
Gray et al.

(10) Patent No.: US 9,451,856 B2
(45) Date of Patent: Sep. 27, 2016

(54) SURFACE TREATING HEAD

(71) Applicant: Dyson Technology Limited, Wiltshire (GB)

(72) Inventors: Jonathan James Gray, Bristol (GB); Simon Peter Cross, Bristol (GB)

(73) Assignee: DYSON TECHNOLOGY LIMITED, Malmesbury, Wiltshire (GB)

( * ) Notice: Subject to any disclaimer, the term of this patent is extended or adjusted under 35 U.S.C. 154(b) by 0 days.

(21) Appl. No.: 14/664,235

(22) Filed: Mar. 20, 2015

(65) Prior Publication Data

US 2015/0265115 A1 Sep. 24, 2015

(30) Foreign Application Priority Data

Mar. 21, 2014 (GB) ..... 1405063.7

(51) Int. Cl.

| | |
|---|---|
| ***A47L 9/02*** | (2006.01) |
| ***A47L 9/00*** | (2006.01) |
| ***A47L 9/24*** | (2006.01) |
| ***A47L 9/04*** | (2006.01) |
| ***A47L 9/06*** | (2006.01) |
| ***A47L 11/30*** | (2006.01) |

(52) U.S. Cl.

CPC ..... *A47L 9/02* (2013.01); *A47L 9/009* (2013.01); *A47L 9/0477* (2013.01); *A47L 9/0666* (2013.01); *A47L 9/242* (2013.01); *A47L 11/30* (2013.01)

(58) Field of Classification Search

CPC ..... A47L 9/02; A47L 9/009; A47L 9/0477; A47L 9/0666; A47L 9/242; A47L 11/30

See application file for complete search history.

(56) References Cited

U.S. PATENT DOCUMENTS

| | | | | |
|---|---|---|---|---|
| 8,555,462 | B2 * | 10/2013 | Maguire | A47L 9/0411 15/358 |
| 2010/0257680 | A1 * | 10/2010 | Maguire | A47L 9/0433 15/21.1 |
| 2010/0257695 | A1 * | 10/2010 | Maguire | A47L 9/009 15/415.1 |
| 2010/0257696 | A1 * | 10/2010 | Maguire | A47L 9/06 15/415.1 |

FOREIGN PATENT DOCUMENTS

| | | |
|---|---|---|
| DE | 198 06 137 | 8/1999 |
| DE | 10 2011 077 275 | 12/2012 |
| EP | 0 793 938 | 9/1997 |
| EP | 0793938 | 9/1997 |

(Continued)

OTHER PUBLICATIONS

Search Report mailed Sep. 18, 2014, directed to GB Application No. 1405063.7; 1 page.

(Continued)

*Primary Examiner* — Dung Van Nguyen

(74) *Attorney, Agent, or Firm* — Morrison & Foerster LLP

(57) ABSTRACT

A surface treating head comprising a first body defining an inner aperture, and a support body defining an outer aperture, the outer aperture surrounding the inner aperture, and the support body being moveable relative to the first body to allow for relative movement between the inner and outer apertures in a substantially vertical direction, wherein the surface treating head further comprises a bellow seal provided between the first body and the support body that maintains a substantially airtight seal between the first body and support body irrespective of their relative positions and movements.

13 Claims, 6 Drawing Sheets

(56) References Cited

FOREIGN PATENT DOCUMENTS

| | | |
|---|---|---|
| JP | 46-6363 | 3/1971 |
| JP | 52-70569 | 6/1977 |
| JP | 52-79758 | 6/1977 |
| JP | 61-217126 | 9/1986 |

OTHER PUBLICATIONS

International Search Report and Written Opinion mailed Jul. 24, 2015 directed towards International Application No. PCT/GB2015/050578; 14 pages.

* cited by examiner

SURFACE TREATING HEAD

REFERENCE TO RELATED APPLICATIONS

This application claims the priority of United Kingdom Application No. 1405063.7, filed Mar. 21, 2014, the entire contents of which are incorporated herein by reference.

FIELD OF THE INVENTION

The present invention relates to a surface treating head.

BACKGROUND OF THE INVENTION

Surface treating appliances such as vacuum cleaners are usually provided with one or more surface treating heads, often referred to as a cleaner head. It is common for cleaner heads to be able to be manipulated between different "modes" of use. The different modes can, for example, allow for more effective cleaning by the surface treating head on different types of floor surface, such as carpeted or hard floors.

One example of the different modes that can be provided in a surface treating head is to have a set of brushes that can be raised or lowered with respect to a soleplate. In a raised position, the soleplate may be positioned lower than the brushes, and so will be in direct contact with the floor surface being cleaned. This mode is particularly beneficial when cleaning carpeted floors. This allows working edges provided on the soleplate to penetrate into the carpet and positions a suction cavity opening in close proximity to the carpet, both of which help to improve pick-up of dirt trapped within the carpet. However, on a hard floor surface, the working edges would slide along the surface of the floor with barely any effect on loosening the dust and dirt to be picked up, and would therefore act to worsen the pick-up performance. Therefore, the set of brushes can be lowered below the soleplate which act to loosen the dirt on a hard floor surface in advance of the suction cavity passing over the hard floor surface, such that dirt pick-up is improved.

Unfortunately, movable brushes within the surface treating head can give rise to a decrease in suction if air is able to pass through any gaps formed between the brushes and the body of the surface treating head. Furthermore, it is well-known that to improve suction, it is desirable to provide a good seal between the suction cavity and the floor surface being cleaned. Having brushes that move up and down can also disrupt the seal and can reduce the suction generated at the floor surface.

SUMMARY OF THE INVENTION

This invention provides a surface treating head comprising a first body defining an inner aperture, and a support body defining an outer aperture, the outer aperture surrounding the inner aperture, and the support body being moveable relative to the first body to allow for relative movement between the inner and outer apertures in a substantially vertical direction, wherein the surface treating head further comprises a bellow seal provided between the first body and the support body that maintains a substantially airtight seal between the first body and support body irrespective of their relative positions and movements.

As a result, the relative positions of the two apertures can be adjusted to provide the surface treating head with an optimum configuration for suction, dirt pick-up and cleaning performance over a variety of floor surfaces. By providing the surface treating head with a bellow seal between the first body and the support body, any relative position between the first body and support body can be selected, and any movement between the two apertures during use can take place without any negative impact on the suction achieved between the surface treating head and a floor surface being cleaned. This may result in an improved surface treating head that can better adapt to provide an advantageous configuration to achieve an optimum cleaning performance on a number of different floor types.

When the first body and support body are in a first relative position the outer aperture may be above the inner aperture in a vertical direction, and when the first body and support body are in a second relative position, the outer aperture may be below the inner aperture in a vertical direction. As a result, either the inner aperture or the outer aperture can be selected to be closest to, or even in contact with, an area of floor surface being cleaned, as one of the inner or outer aperture may provide a better cleaning performance for a specific floor type.

The bellow seal may be in an expanded configuration when the first body and support body are in the first relative position, and the bellow seal may then be in a collapsed configuration when the first body and the support body are in the second relative position. Alternatively, the bellow seal may be in a collapsed configuration when the first body and support body are in the first relative position, and the bellow seal may then be in an expanded configuration when the first body and the support body are in the second relative position. By expanding and collapsing in response to movement between the first body and support body, an airtight seal can be achieved which is maintained regardless of their relative positions and movement.

The surface treating head may further comprise a biasing means for biasing one or more of the first body and support body into a biased position that is one of the first or second relative positions. By biasing one or more of the first body and support body into one or other of the first and second relative positions, without any other influence the surface treating head will automatically adopt that position. Therefore, effort from the user to determine which relative position the first body and support body are in may not be required.

The surface treating head may further comprise a user-operated lever that moves the one or more of the first body and the support body from the biased position to the other of the first or second relative positions. This allows the user to easily move the relative positions of the first body and support body against the force of the biasing means out of the biased position. The surface treating head may further comprise a catch for releasably holding one or more of the first body and support body in the other of the first or second relative positions that is not the biasing position. This will allow the first body and support body to be held in position against the force of the biasing means. If the catch is subsequently released the first body and support body would then move back into the biased position.

The biasing means may bias the support body away from the first body into the second relative position, and an adjacent floor surface may provide a force against the biasing means to move the support body towards the first body into the first relative position. This can allow the support body to move up and down freely in response to a changing floor surface type, which ensures that the outer aperture remains in contact with the floor surface, maintaining an outer seal between the floor surface and the outer aperture whether or not the inner aperture is also in contact with the floor surface. This can act to provide a more robust suction seal between the surface treating head and the floor surface.

The first body and support body may be able to be positioned in an intermediate relative position between the first and second relative positions during use. This enables the two bodies to adopt a relative position that may provide a better seal with the floor surface than either of the first and second relative positions, which may improve suction and therefore cleaning performance of the surface treating head.

The first body may comprise a suction cavity, and the suction cavity may comprise a brushbar. The inner aperture may be a suction cavity opening.

The outer aperture of the support body may comprise one or more of the list comprising bristles, TPU, felt and rubber. Each of these materials may provide a beneficial effect when cleaning any specific floor type. For example. TPU provides a particularly good seal with an adjacent floor surface which can improve suction, however bristles will work better to agitate dirt on a floor surface. A combination may be achieved that then provides the surface treating head with a combination of the benefits of each material.

One or more of the first body and support body may comprise floor engaging wheels. Wheels can be used to improve mobility of the surface treating head over the floor surface and can also be used to ensure a predetermined distance is maintained between an adjacent floor surface and one or more of the first body and support body. This may be particularly beneficial, for example, on a hard floor surface and when the first body may be held above the floor surface by floor engaging wheels within the first body. In that instance, only the outer aperture contacts the floor, and creates a larger outer seal. Alternatively, or in addition, the first body and/or support body may comprise floor engaging wheels that serve to prevent the support body from being drawn towards the floor surface too much by the suction force, which could increase motion resistance.

This invention further provides a vacuum cleaner comprising a surface treating head as described in any one of the preceding claims.

BRIEF DESCRIPTION OF THE DRAWINGS

In order that the present invention may be more readily understood, embodiments of the invention will now be described, by way of example, with reference to the accompanying drawings, in which.

DETAILED DESCRIPTION OF THE INVENTION

Figure 1:
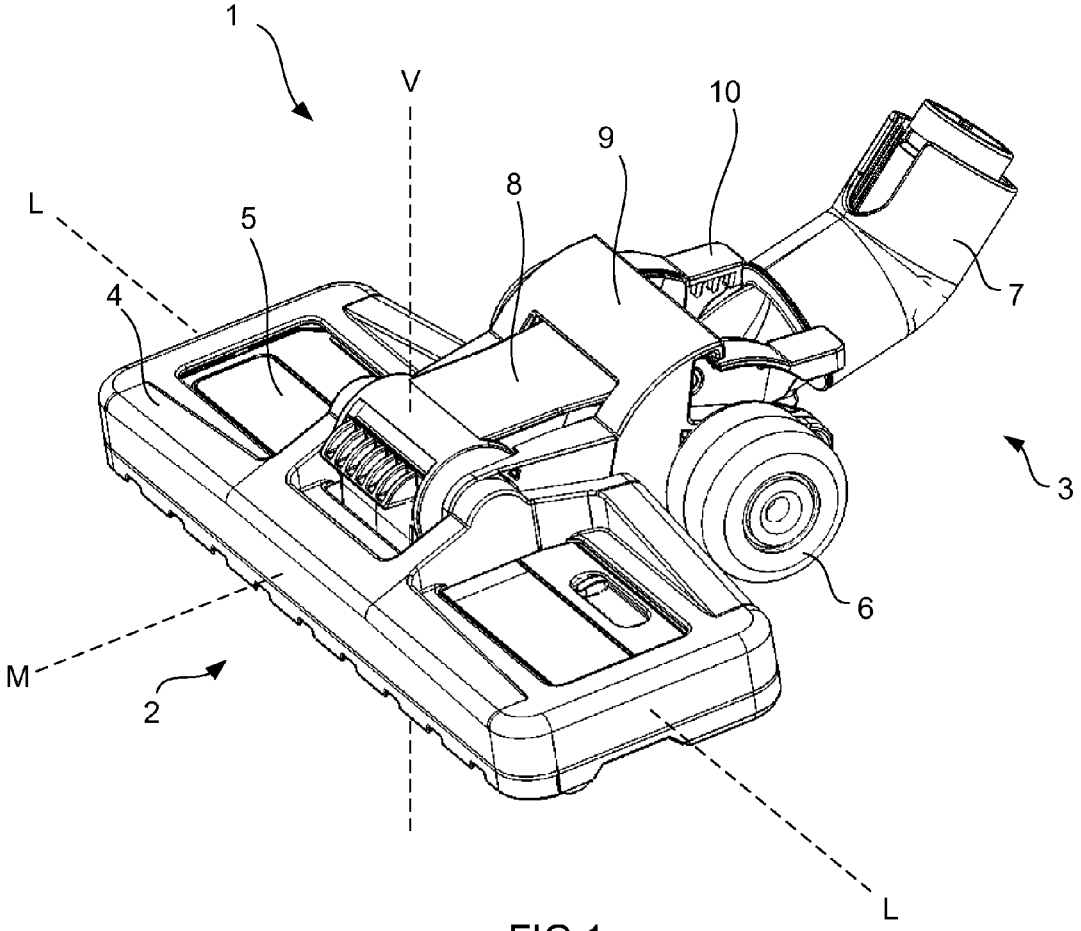
FIG. 1 is a perspective view of a surface treating head in accordance with a first embodiment of the present invention.
Figure 2:
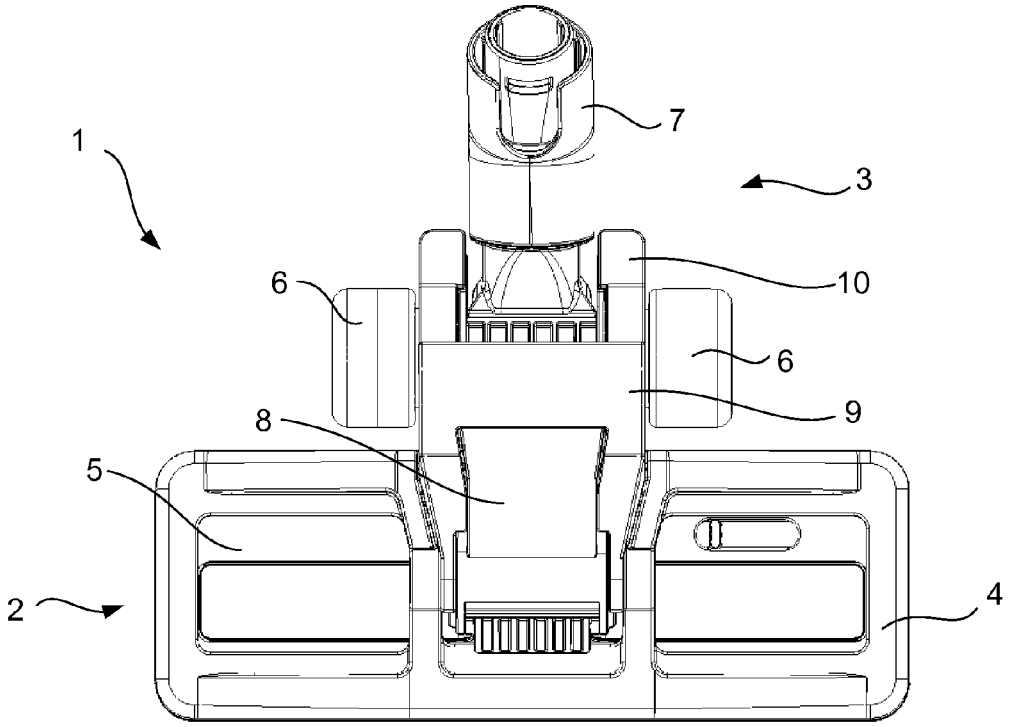
FIG. 2 is a top view of the surface treating head of FIG. 1.
Figure 3:
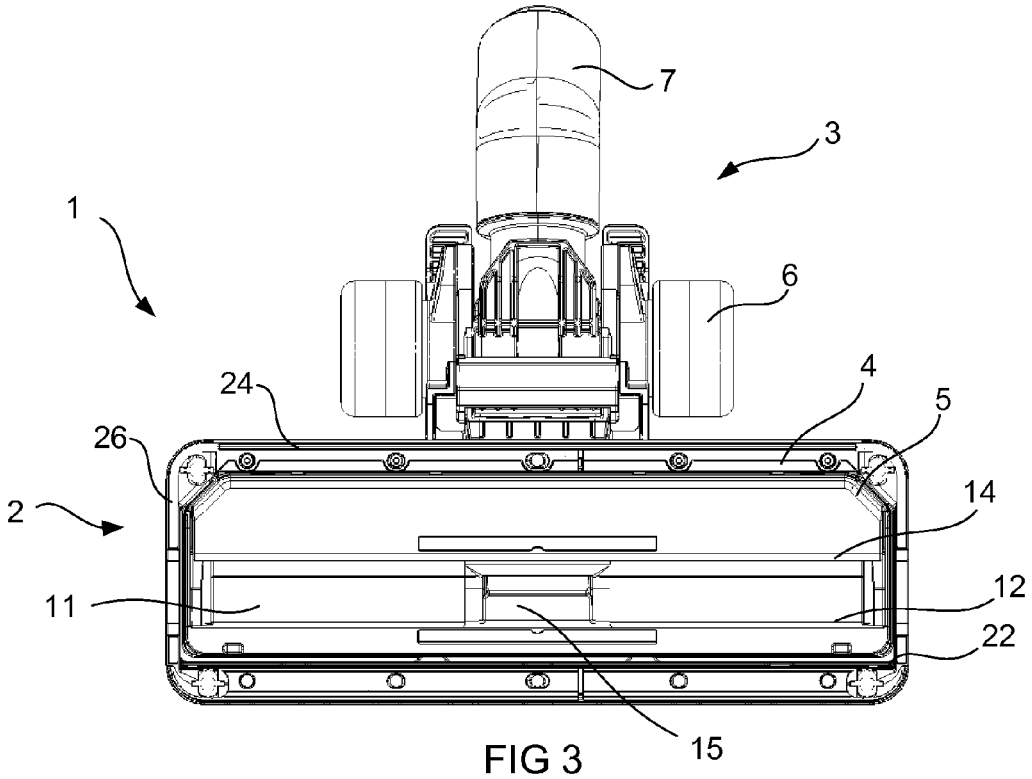
FIG. 3 is a bottom view of the surface treating head of FIGS. 1 and 2.

FIGS. 1, 2 and 3 show a surface treating head 1. The surface treating head 1 comprises a main body 2 and a rolling support 3. The main body 2 comprises a first body which is a soleplate body 5, a support body 4 that surrounds the soleplate body 5. The support body 4 and the soleplate body 5 are moveable relative to one another in a substantially vertical direction, i.e. substantially parallel to axis V. The rolling support 3 comprises wheels 6 and a swivel duct 7. The swivel duct 7 allows the surface treating head 1 to be attached to a vacuum cleaner, for example by way of a wand attachment in the case of a cylinder- or canister-style vacuum cleaner. The swivel duct 7 is in fluid connection with the main body 2, and in particular with the soleplate body 5, by way of duct 8. Lever 9 and catch 10 are provided on the upper side of the surface treating head 1 and which can be used to select and de-select different relative positions of the soleplate body 5 and the support body 4. This will be explained in more detail below.

FIG. 3 shows the underneath of the surface treating head 1. The underneath of the soleplate body 5 comprises a suction cavity 11 that has a suction cavity opening provided between a front working edge 12 and a rear working edge 14. The relative terms "front" and "rear" are defined in accordance with the direction of use of the surface treating head 1 during a forward sweep in a vacuum cleaning operation (as represented by axis M in FIG. 1). The suction cavity 11 is in fluid connection with the duct 8 by way of duct opening 15. The suction cavity opening defines a floor-facing inner aperture. Around the outside of the soleplate body 5 is the support body 4. The support body has front and rear rubber skirts 22, 24 and hard plastic sides with felt 26, the combination of which defines a floor facing outer aperture which surrounds the inner aperture.

When the support body 4 is in a lowered position, the soleplate body is held above the floor surface while the felt 26 and rubber skirts 22, 24 on the support body 4 make contact with the floor surface. Conversely, when the support body is in a raised position, the soleplate body extends below the support body 4. The felt and rubber skirts of the support body 4 define a floor-facing outer aperture that is positioned circumferentially around the suction cavity opening of the soleplate body 5. The suction cavity opening on the underneath of the soleplate body 5 defines a floor-facing inner aperture positioned within the outer aperture. As the support body 4 and the soleplate body are moveable with respect to one another in a substantially vertical direction, the relative vertical positions of the two apertures can be adjusted such that the inner aperture is either above or below the outer aperture in a vertical direction. When the outer aperture is below the inner aperture, the felt and rubber skirts create a seal with the floor surface, and provide an improved suction with a hard floor surface. As an alternative to the felt and rubber skirts, the support body 4 may be provided with, any one or combination of, for example, bristles, rubber, felt and/or thermoplastic polyurethane (TPU) strips. Of course it will be understood that this is not an exhaustive list, and other suitable alternative materials that can be provided on the support body will be apparent.

Figure 4:
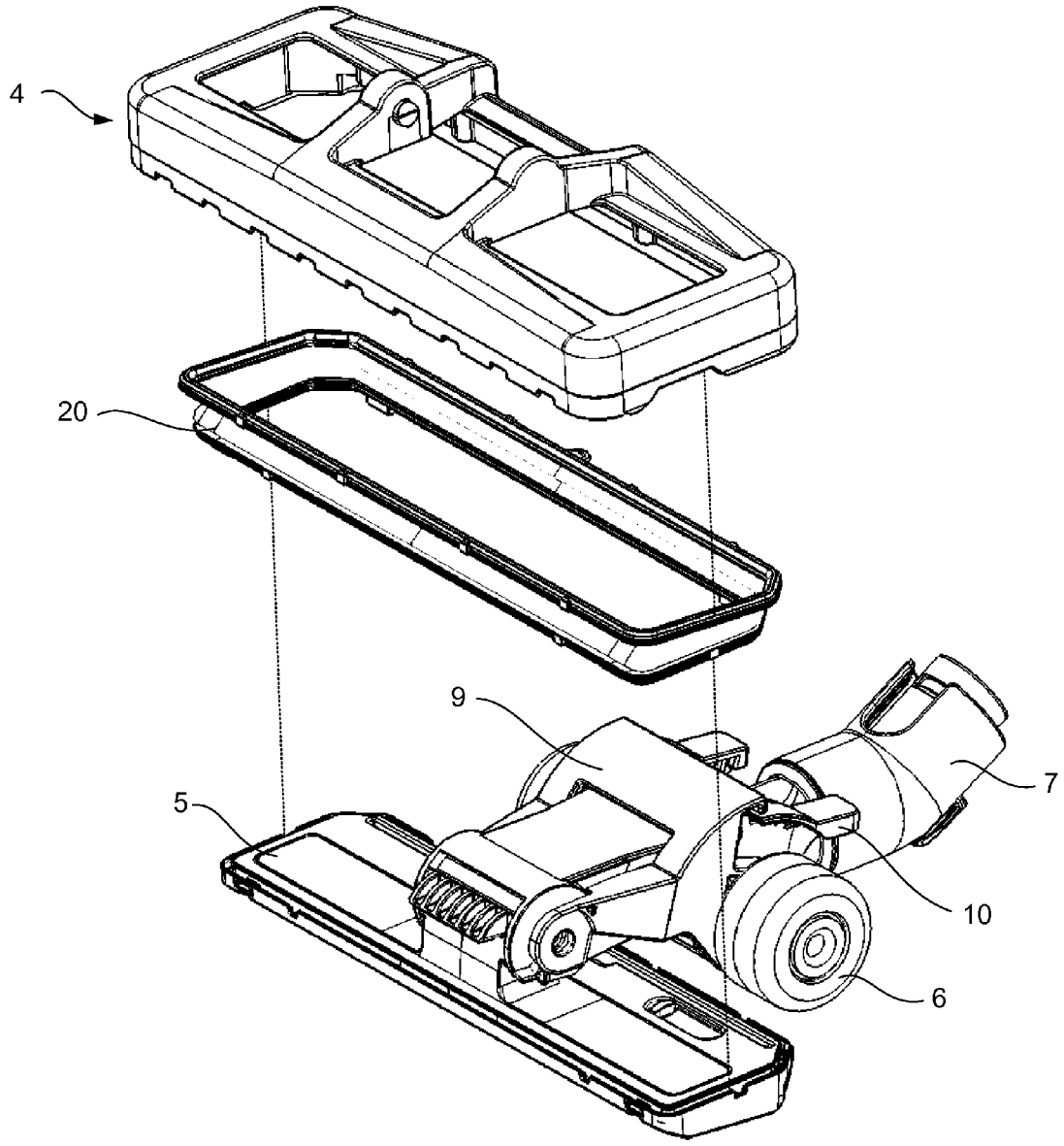
FIG. 4 is a part-exploded perspective view of the surface treating head of FIGS. 1 to 3.

FIG. 4 shows the surface treating head 1 with the support body 4 lifted away from the rest of the surface treating head. A bellow seal 20 is provided between the soleplate body 5 and the support body 4 such that when they are brought together, an airtight seal is created between the soleplate body and the support body which prevents air from passing between them. As the seal is a bellow seal 20, it is able to provide an airtight seal between the two bodies 4 and 5 irrespective of their relative positions, or any movement between the two. This prevents any loss of suction at the surface treating head 1 due to air passing through the gap between the support body 4 and the soleplate body 5.

Figure 5:
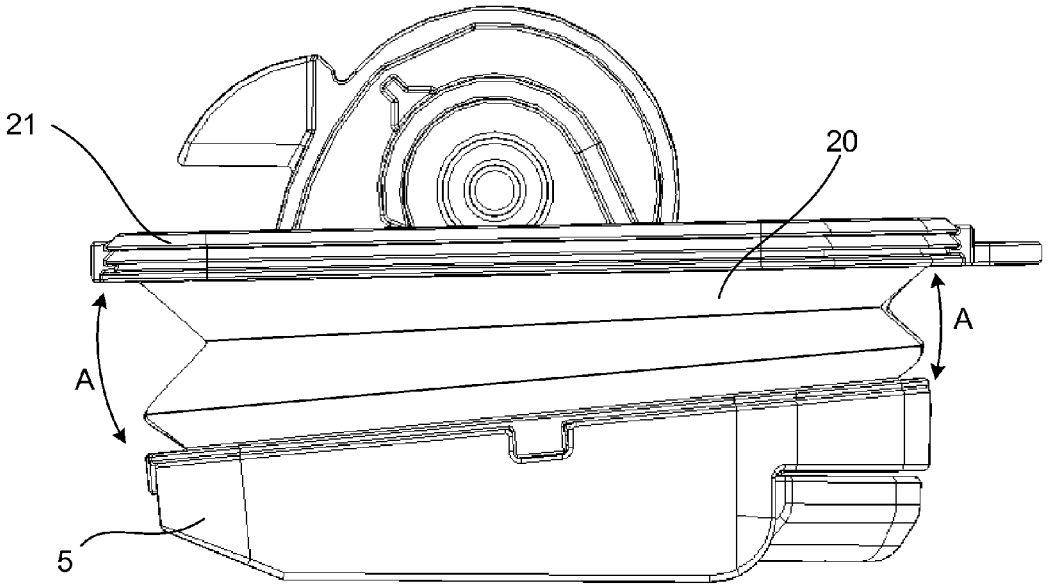
FIGS. 5 and 6 are side views of a soleplate body and bellow seal used in the surface treating head of FIGS. 1 to 3.
Figure 6:
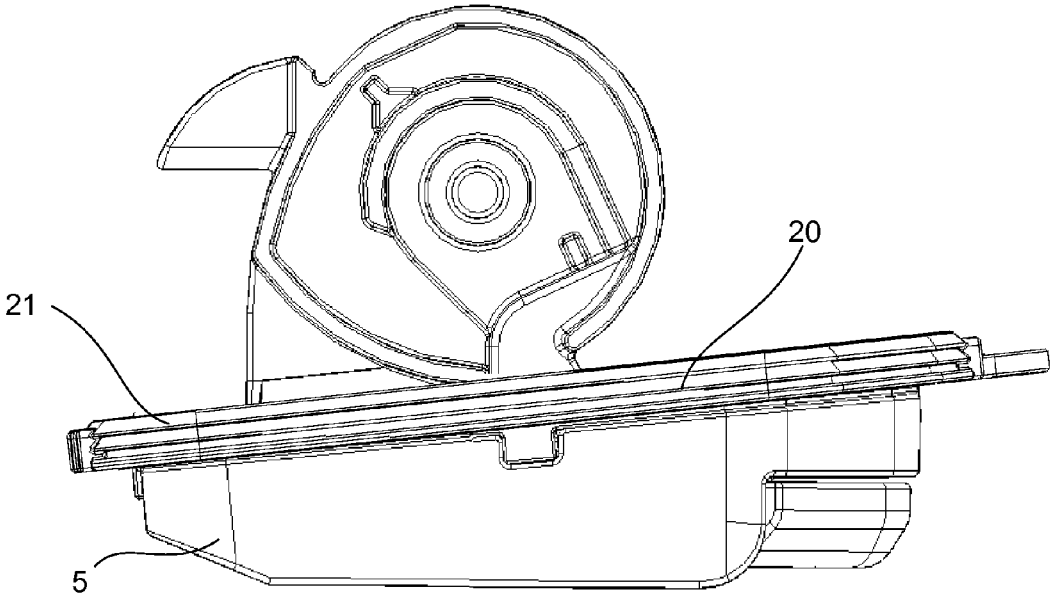

FIG. 5 shows the soleplate body 5 with the bellow seal 20 attached, the bellow seal being in an expanded configuration. As shown by arrows A, the bellow seal is able to collapse and expand as required in response to movement of the top of the seal with respect to the bottom of the seal. The upper rim of the seal 21 is provided with rubberised deformable ribs and can engage into a corresponding receiving groove on the support body 4. A similar lower rim, which cannot be seen in FIG. 5, is provided on the bottom of the bellow seal and is engaged in a receiving groove on the top surface of the soleplate body 5. FIG. 6 shows the same soleplate body 5 and bellow seal 20, but with the bellow seal 20 in a collapsed configuration.

Figure 7:
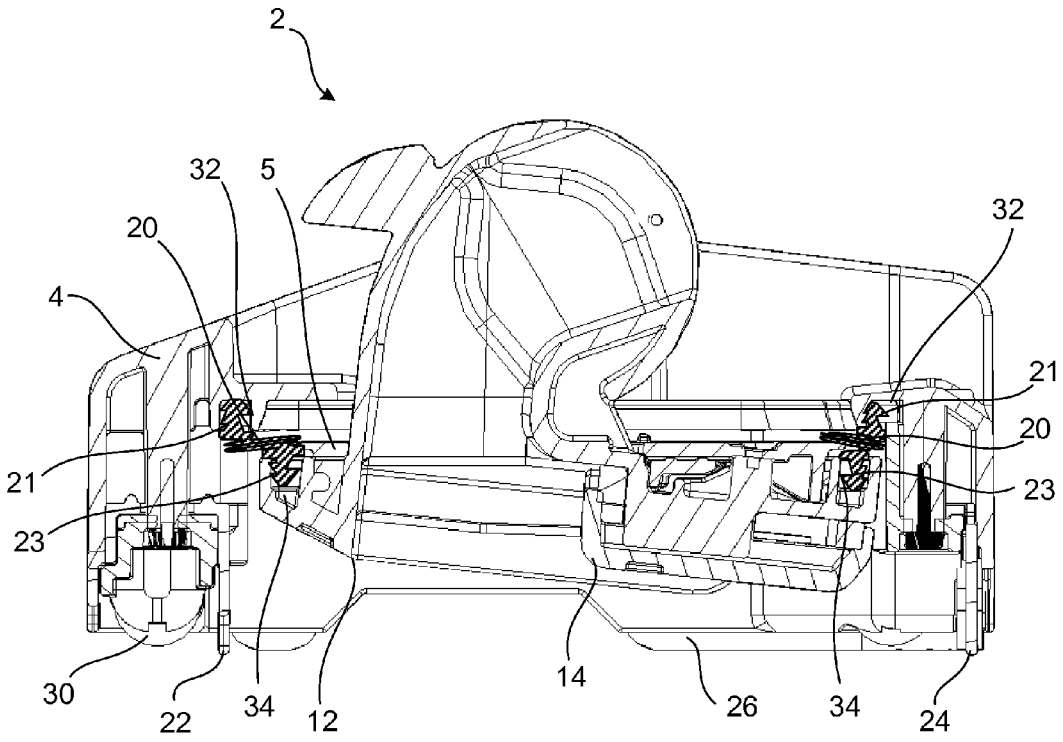
FIGS. 7 and 8 are cross-sections through the surface treating head of FIGS. 1 to 3.
Figure 8:
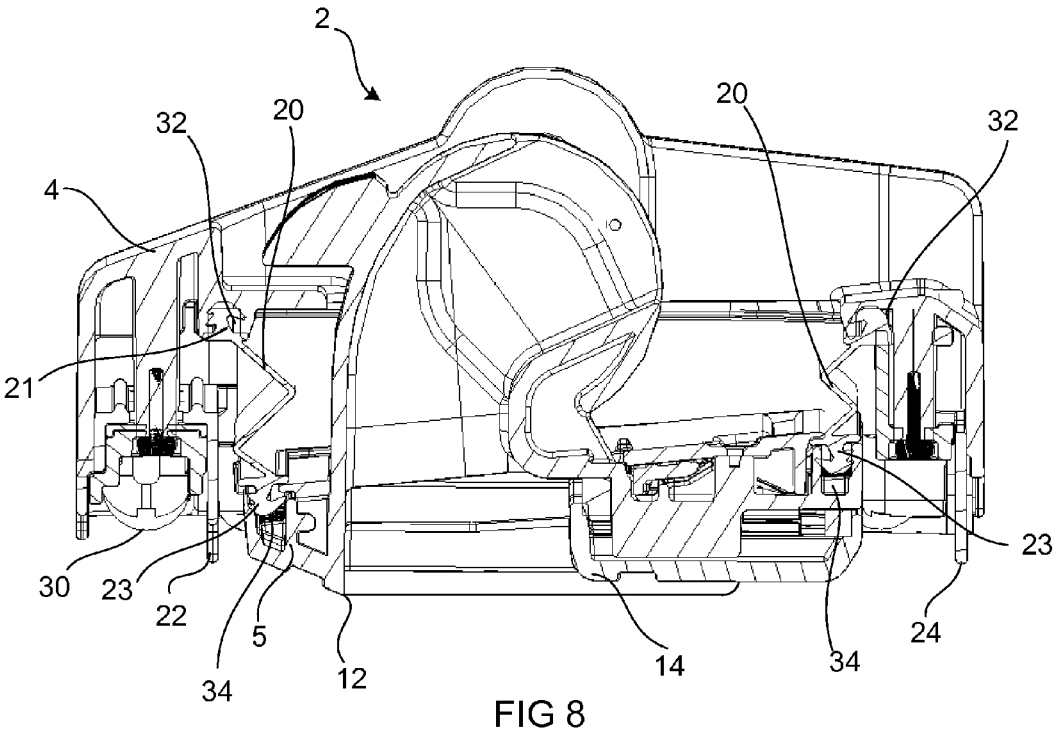

FIGS. 7 and 8 show cross sections through the centre of the main body 2 of the surface treating head 1 in two different configurations. The soleplate body has a front working edge 12 and a rear working edge 14 which, as previously described, define an inner aperture. The support body 4 has front and rear rubber skirts 22, 24 and felt sections 26 along each of the sides that extend between the front and rear rubber skirts 22, 24. The rubber skirts 22, 24 and the felt 26 define the outer aperture as previously described. In FIG. 7, the support body 4 is in a lowered, or deployed, position relative to the soleplate body 5. In this configuration the outer aperture is positioned vertically below the inner aperture. The outer aperture will therefore contact the floor surface that is being cleaned. This allows the rubber skirts 22, 24 to travel over the floor surface and agitate any dirt on the surface in order to improve pick-up. This configuration is particularly beneficial when the floor surface being cleaned is a hard floor surface. When the support body is in the lowered position, as shown in FIG. 7, it can clearly be seen from the cross sectional view that the bellow seal 20 is in a collapsed state. The bellow seal 20 has upper and lower rims 21, 23 that fit into receiving grooves 32, 34 on the soleplate body 5 and the support body 4. The upper rim 21 of the bellow seal is inserted into receiving groove 32 provided on the underneath of an upper section of the support body 4, and the lower rim 23 is inserted into receiving groove 34 provided on the top surface of the soleplate body 5. The bellow seal is able to concertina into a small area between the top surface of the soleplate body 5 and the underneath of the upper section of the support body 4. Despite being in a collapsed state, the bellow seal 20 is able to ensure that no air passes between the gap formed between the soleplate body 5 and the support body 4, and accordingly there is no corresponding no loss of suction when the support body 5 is deployed.

In FIG. 8, the support housing 4 is in a raised position relative to the soleplate body 5. In this configuration the inner aperture is positioned lower than the outer aperture. In use, the underneath of the soleplate body, and therefore the inner aperture will contact the floor while the outer aperture is held in a position away from the floor surface so that the rubber skirts 22, 24 and the felt 26 do not make contact with the floor surface. This configuration is particularly beneficial when the floor surface being cleaned is a carpeted floor. The front and rear working edges 12, 14 are able to penetrate into the pile of the carpet, which improves dirt pick-up. When the support body is in the raised position, as shown in FIG. 8, it can clearly be seen from the cross sectional view that the bellow seal 20 is in an expanded state. The upper and lower rims 21, 23 of the bellow seal 20 are still located within the receiving grooves 32 and 34, but now the remainder of the bellow seal 20 is expanded to account for the increased distance between the upper and lower rims 21, 23. In the expanded state, the bellow seal still ensures a good airtight seal that stops air from passing between the soleplate body 5 and the support body 4. Whilst such an airtight seal is less important when the support body is in a raised position in this embodiment, it is beneficial to have a bellow seal that is able to provide an airtight seal at all times. For example, it may be possible to provide a regular seal between the soleplate body 5 and the support body 4 that creates a seal when the two bodies 4 and 5 come into abutment with one another. However, this would require that the parts are made within relatively tight manufacturing tolerances, which can increase the cost of manufacturing the surface treating head. By using a bellow seal, any differences in manufacturing tolerances can easily be absorbed, and so the cost of manufacturing the surface treating head can be kept down.

During use the user is able to move the support body 4 and/or soleplate body 5 in order to select one or other of the two configurations described above. A biasing means (not shown) biases the two bodies relative to one another into one or other of the configurations, known as the biasing position. In the embodiment shown in FIGS. 1 to 8, the biasing means biases the support body 4 into the raised position described above and shown in FIG. 8, such that the inner aperture of the soleplate body 5 protrudes below the outer aperture of the support body 4, and the rubber skirts 22, 24 and felt 26 of the support body 4 are held above the floor surface. A lever, such as lever 9 shown in FIG. 1, is then used to move the soleplate body 5 and/or the support body 4 relative to one another into the alternative configuration, i.e. with the support body in the lowered, or deployed, position. When the two bodies have been moved into their new relative positions, a catch 10 holds the two bodies in their relative positions against the force of the biasing means. The catch 10 can then be released to allow the biasing means to return the soleplate body 5 and the support body 4 back into their respective "biased" positions. The lever 9 and the catch 10 preferably can be actuated by foot, which makes the act of selecting a different configuration (i.e. surface treating head "mode") much easier for the user during use.

The support body 4 is provided with wheels 30, which help to reduce motion resistance of the surface treating head 1 when the support body 4 is deployed. The suction force when the support body is deployed could cause the support body to be drawn towards the floor surface with such a great force that the rubber skirts 22, 24 deform and the surface treating head 1 is difficult to move. The wheels 30 prevent the support body 4 from being drawn towards the floor surface too much, leading to the rubber skirts from being deformed. In addition to the wheels 30, air bleeds may be provided in the surface treating head 1 to help reduce the suction force generated between the floor surface and the surface treating head 1.

Figure 9:
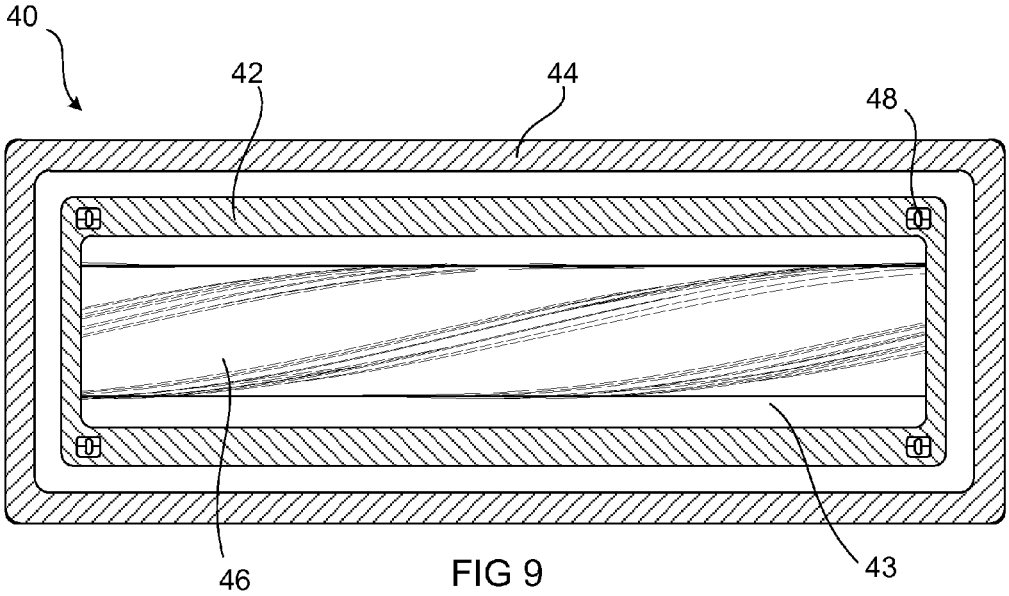
FIG. 9 is a bottom view of a surface treating head in accordance with another embodiment of the present invention.
Figure 10:
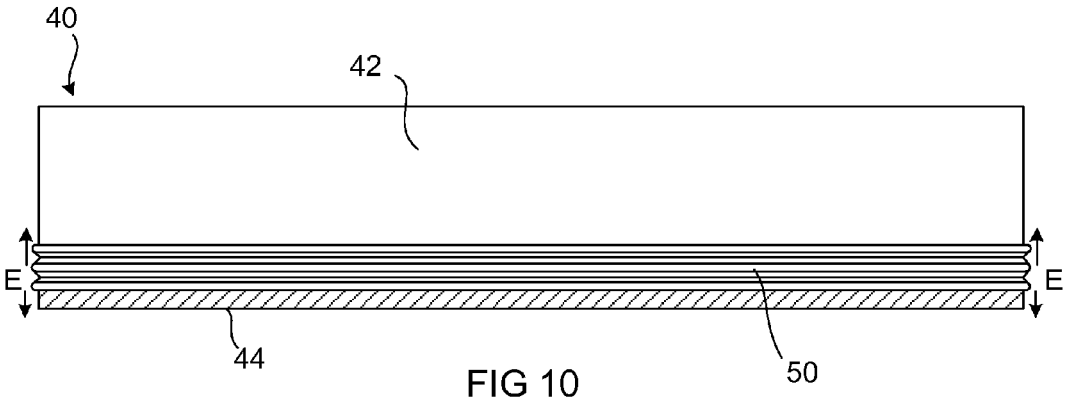
FIGS. 10 and 11 are front views of the surface treating head of FIG. 9.
Figure 11:
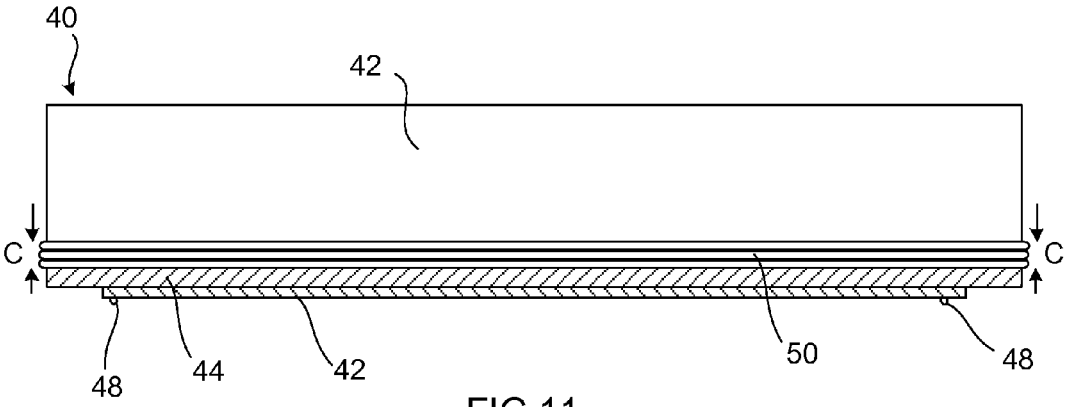

An alternative embodiment is shown in FIGS. 9 to 11. FIG. 9 shows the underneath of a surface treating head 40. The surface treating head previously described in relation to FIGS. 1 to 8 is typically known as a passive head, which means is does not contain a rotating brushbar. The surface treating head 40 of FIGS. 9 to 11 is an active head, and so contains a rotating brushbar 46 within the suction cavity 43. The surface treating head comprises a first body in the form of a soleplate body 42 which has a suction cavity opening that defines an inner aperture. A support body 44 is provided that defines an outer aperture which surrounds the inner aperture of the soleplate body 42. The soleplate body 42 is provided with supporting wheels 48 that are able to support the soleplate body 42 when travelling along a hard floor. This maintains an even separation gap between a hard floor surface and the soleplate body 42 such that the inner aperture does not contact the floor surface. On a carpeted floor surface, the wheels are able to penetrate into the pile of the carpet.

The support body 44 is attached to a part of the soleplate body 42 above the floor surface facing inner aperture by way of a bellow seal 50. In this embodiment, the support body 44 is biased in a downwards direction away from the soleplate body 42 by a biasing means (not shown). FIG. 10 shows a front view of the surface treating head 40 with the support body 44 in a lowered position. In this lowered position, the support body 44 extends below the soleplate body 42, such that the outer aperture is positioned vertically lower than the inner aperture. In this instance, the bellow seal 50 is in an expanded state, as indicated by arrows E. This is typically the configuration that is adopted when the surface treating head 40 is in use on a hard floor surface. The wheels 48 of the soleplate body 42 hold the inner aperture away from the floor surface, and the biasing means forces the support body 44 downwards such that the outer aperture contacts the floor surface. The outer aperture therefore creates a good seal with the floor surface and improved pick-up performance can be achieved. Soft bristles, for example carbon bristles, may be provided on the brushbar 46 that extend outwards of the suction cavity 43 such that they are able to reach the hard floor surface even when the soleplate body 42 is held away from the floor surface by the wheels 48. The soft bristles can then help to draw dirt and dust from the hard floor surface into the suction cavity 43 during use. Around the outer aperture, the support body 44 may be provided with one or a combination of a rubber skirt, felt or thermoplastic polyurethane (TPU). Of course it will be understood that this is not an exhaustive list, and other suitable alternative materials that can be provided on the support body will be apparent.

FIG. 11 shows a front view of the surface treating head 40 with the support body 44 in a raised position. In this raised position, the soleplate body 42 protrudes below the support body 44 such that the inner aperture is positioned vertically lower than the outer aperture. In this instance, the bellow seal 50 is in a collapsed state, as indicated by arrows C. This is typically the configuration that is adopted when the surface treating head 40 is in use on a carpeted floor surface. As previously explained, the wheels 48 are able to penetrate into the carpet pile, and accordingly the inner aperture will contact the floor surface. The carpet provides an upwards force that counteracts the biasing force acting on the support body 44, and so the support body 44 adopts the raised position, collapsing the bellow seal 50 between the support body 44 and the soleplate body 42. Working edges on the soleplate body 42 may be able to penetrate into the carpet to provide improved dirt pick-up. Alternatively, or in addition to the working edges, the brushbar 46 may comprise hard bristles that are able to penetrate the carpet when the soleplate body itself penetrates the surface of the carpet. The rotating bristles will then act to agitate the dirt and dust within the pile of the carpet, which will then be drawn into the suction cavity by the suction from the vacuum cleaner. The hard bristles are usually shorter than the soft bristles, and would not be able to contact a hard floor surface. This stops the hard bristles from scratching or marking a hard floor surface during a cleaning operation.

In the alternative embodiment shown in FIGS. 9 to 11, the relative positioning of the soleplate body 42 and support body 44 is not selected by a user in the same way as the previous embodiment shown in FIGS. 1 to 8. Instead, the support body 44 is constantly biased down towards the floor surface. As the surface treating head travels from one floor surface to another, the relative vertical positioning of the support body 44 with respect to the soleplate body 42 will adjust according to the amount that the soleplate body 42 is able to penetrate into the floor surface. Accordingly, the surface treating head 40 will always maintain a good seal with the floor surface, and an optimum level of pick-up can be achieved without requiring any input from the user. Furthermore, no matter what relative positions the soleplate body 42 and the support body 44 have, and irrespective of any movement between the two, a constant airtight seal will be maintained by the bellow seal 50 to stop any air from passing between the two bodies 42, 44.

The support body 44 is shown as having an outer aperture of even height the entire way around, such that an even seal is created with the floor surface around the entire outer aperture. However, air bleeds may be provided as required to allow some air to enter through the air bleeds when the aperture is in contact with the floor surface. The figures show the soleplate body 42 having wheels 48, however these may not necessarily be required, or may be used on the support body 44 instead of or in addition to the soleplate body 42.

Whilst particular embodiments have thus far been described, it will be understood that various modifications may be made without departing from the scope of the invention as defined by the claims.

The invention claimed is:

1. A surface treating head comprising:

a first body defining an inner aperture; and a support body defining an outer aperture, the outer aperture surrounding the inner aperture, and the support body being moveable relative to the first body to allow for relative movement between the inner and outer apertures in a substantially vertical direction;

wherein the surface treating head further comprises a bellow seal provided between the first body and the support body that maintains a substantially airtight seal between the first body and support body irrespective of their relative positions and movements;

wherein when the first body and support body are in a first relative position, the outer aperture is above the inner aperture in a vertical direction, and when the first body and support body are in a second relative position, the outer aperture is below the inner aperture in a vertical direction; and wherein the surface treating head further comprises a bias for urging one or more of the first body and the support body into a biased position that is the first relative position or the second relative position.

2. The surface treating head of claim 1, wherein the bellow seal is in an expanded configuration when the first body and support body are in the first relative position, and the bellow seal is in a collapsed configuration when the first body and the support body are in the second relative position.

3. The surface treating head of claim 1, wherein the bellow seal is in a collapsed configuration when the first body and support body are in the first relative position, and the bellow seal is in an expanded configuration when the first body and the support body are in the second relative position.

4. The surface treating head of claim 1, further comprising a user-operated lever that moves the one or more of the first body and the support body from the biased position to the other of the first or second relative positions.

5. The surface treating head of claim 1, further comprising a catch for releasably holding one or more of the first body and support body in the other of the first or second relative positions that is not the biased position.

6. The surface treating head of claim 1, wherein the bias urges the support body away from the first body into the second relative position, and an adjacent floor surface provides a force against the bias to move the support body towards the first body into the first relative position.

7. The surface treating head of claim 1, wherein the first body and support body can be positioned in an intermediate relative position between the first and second relative positions during use.

8. The surface treating head of claim 1, wherein the first body comprises a suction cavity.

9. The surface treating head of claim 8, wherein the suction cavity houses a brushbar.

10. The surface treating head of claim 1, wherein the inner aperture is a suction cavity opening.

11. The surface treating head of claim 1, wherein the outer aperture of the support body comprises one or more of the list comprising bristles, TPU, felt and rubber.

12. The surface treating head of claim 1, wherein one or more of the first body and support body comprise floor engaging wheels.

13. A vacuum cleaner comprising a surface treating head as claimed in claim 1.

* * * * *